US005580355A

United States Patent [19]

Groth et al.

[11] Patent Number: 5,580,355

[45] Date of Patent: Dec. 3, 1996

[54] LEATHER TANNING AGENT AND STANDARDIZING AGENTS FOR DYESTUFFS

[75] Inventors: Torsten Groth; Winfried Joentgen, both of Köln; Ulrich Müller, Bergisch Gladbach; Bruno Bömer, deceased, late of Bergisch Gladbach, by Karin E. Bömer née Dick, legal representative, Felix M. Bömer, heir; Guido M. Bömer, heir, Bonn; Harro Träubel, Leverkusen, all of Germany

[73] Assignee: Bayer Aktiengesellschaft, Leverkusen, Germany

[21] Appl. No.: 552,326

[22] Filed: Nov. 2, 1995

[30] Foreign Application Priority Data

Nov. 9, 1994 [DE] Germany ..... 44 39 990.1

[51] Int. Cl.[6] ..... C14C 3/18

[52] U.S. Cl. ..... 8/94.33; 8/94.21; 8/94.26; 252/8.57

[58] Field of Search ..... 8/94.33, 94.21, 8/94.26, 94.19 R, 552, 557, 594, 595, 436; 252/8.57

[56] References Cited

U.S. PATENT DOCUMENTS

| | | | |
|---|---|---|---|
| 2,205,883 | 6/1940 | Graves . | |
| 2,205,901 | 6/1940 | Kirk . | |
| 3,846,380 | 11/1974 | Fujimoto et al. | 525/328.2 |
| 4,527,992 | 7/1985 | Friese et al. . | |
| 4,696,981 | 9/1987 | Harada et al. . | |
| 4,839,461 | 6/1989 | Boehmke . | |
| 5,124,181 | 6/1992 | Schaffer et al. . | |
| 5,288,783 | 2/1994 | Wood . | |
| 5,296,578 | 3/1994 | Koskan et al. . | |
| 5,316,860 | 5/1994 | Stewart et al. . | |

FOREIGN PATENT DOCUMENTS

| | | |
|---|---|---|
| 2142047 | 1/1973 | France . |
| 2253190 | 5/1973 | Germany . |
| 1400741 | 7/1975 | United Kingdom . |
| 1404814 | 9/1975 | United Kingdom . |
| 1581678 | 12/1980 | United Kingdom . |

OTHER PUBLICATIONS

H. Traeubel et al, JALCA, vol. 80 (1985) 261–274 (Month Unknown).

J. Kovacs et al, J. Org. Chem., vol. 26, pp. 1084–1091 (1961) (Month Unknown).

F. Schade et al, Das Leder 33 (1982), 141–154 (Month Unknown).

H. Traeubel et al, JALCA 83 (1988) 193–205 (Month Unknown).

*Primary Examiner*—Prince Willis, Jr.
*Assistant Examiner*—Alan D. Diamond
*Attorney, Agent, or Firm*—Sprung Horn Kramer & Woods

[57] ABSTRACT

Polyaspartic acid and its salts and anhydrides are outstandingly suitable as tanning agents, as retanning agents and as standardizing agents for dyestuffs.

1 Claim, No Drawings

LEATHER TANNING AGENT AND STANDARDIZING AGENTS FOR DYESTUFFS

The invention relates to the use of polyaspartic acid and its derivatives for tanning and retanning leather and as standardizing agents for dyestuffs, preferably for leather dyestuffs.

Tanning converts animal hides into leather by crosslinking collagen. One of the most important features of leather is the increased shrinkage temperature, i.e. the improved resistance to hot water, compared with non-tanned hides and the white appearance (non-transparent, non-parchmentlike) after drying. "Retanning" is understood as meaning the after-treatment of pretanned (in general chrome-tanned) leather in order to optimize the colour, levelness, softness, plumpness and properties with respect to water (hydrophobicity) and to fix tanning agents.

The use of oligoesters containing carboxyl groups has been recommended, inter alia, for tanning leather, above all for retanning (DE-A 2 626 430; H. Träubel and R. Goffin, "Polyurethane Retanning Materials", JALCA 80 (1985), 261–274); however, this type of treatment does not lead to a satisfactory plumpness of the leather.

Poly(meth)acrylates containing carboxyl groups are an essential content of the customary retanning agents; cf. for example, U.S. Pat. No. 2,205,883; 2,205,901, DE-A 2 755 087. Although the leathers (re)tanned with these polymers have a good plumpness, there is still something to be desired in respect of depth of colour and penetration depth of the dyestuff after dyeing.

Surprisingly, it has now been found that polyaspartic acid has a tanning and retanning action and overcomes the disadvantages of the prior art. Leathers of good softness and plumpness which lead to good depth of colour on dyeing are formed. The good penetration depth of the dyestuff allows the leather to be buffed without substantial shifts in colour shades occurring. Polyaspartic acid furthermore has the advantage of easy biodegradability; this is particularly important because the residual liquors from tanning and retanning are always fed to a clarification plant, where poor degradability has a delaying effect on the purification of the waste water or even renders it impossible. It has furthermore been found that polyaspartic acid fixes non-bonded chrome tanning agent, so that the content of chromium(III) ions in the residual liquors is reduced.

There continues to be an industrial need to be able to employ polymeric tanning agents in powder form because packaging thereof is easier to handle and to dispose of, and because powders can be transported more cheaply—especially over a longer distance.

It has furthermore been found that polyaspartic acid, when used as a standardizing agent for dyestuffs, leads to leather dyeings of improved depth of colour. This effect is particularly pronounced on retanned leathers, i.e. leathers after-treated with anionic products. No sulphate- or chloride-loaded waste waters occur here, as is the case with conventional standardizing agents.

The invention thus relates to the use of polyaspartic acid as a tanning agent, as a retanning agent or as a standardizing agent for dyestuffs.

The term "polyaspartic acid" in the context of the invention includes its salts, preferably its ammonium, potassium and sodium salts, and its anhydrides, such as polysuccinimide. Polysuccinimide can form polyaspartic acid by hydrolysis during use.

The preparation of polyaspartic acid and its derivatives has been the subject of numerous publications for a long time. The preparation can thus be carried out by thermal polycondensation of aspartic acid (J. Org. Chem. 26, 1084 (1961)); cf. also DE-A 2 253 190, U.S. Pat. Nos. 4,696,981, 5,296,578 and 5,288,783.

U.S. Pat. No. 4,839,461 (=EP-A 256 366) describes the preparation of polyaspartic acid from maleic anhydride, water and ammonia. In this process, maleic anhydride is converted into the monoammonium salt in an aqueous medium by addition of concentrated ammonia solution. This maleic acid monoammonium salt can preferably be subjected to a thermal, optionally continuous polymerization at 150° to 180° C. in a reactor over a residence time of 5 to 300 minutes, and the resulting polysuccinimide can be converted into polyaspartic acid or a salt thereof by hydrolysis.

In a preferred embodiment, the polyaspartic acid essentially contains recurring units of the following structure:

a) 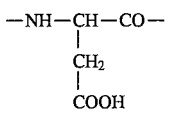 (α-form)

and b) 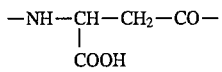 (β-form)

The content of the β-form is in general more than 50%, in particular more than 70%, based on the sum of a+b.

In addition to the recurring aspartic acid units a) and b), the polyaspartic acid can contain other recurring units, for example c) malic acid units of the formula

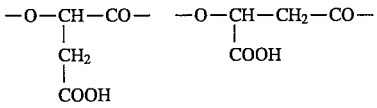

d) maleic acid units of the formula

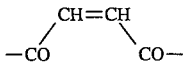

e) fumaric acid units of the formula

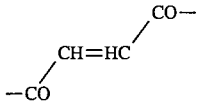

The polyaspartic acid may contain the "other" recurring units in amounts of up to 100% by weight, based on the sum of a+b.

Preferred polyaspartic acids have molecular weights, determined as the weight-average by gel permeation chromatography (calibrated with polystyrene) of 500 to 10,000, preferably 1000 to 5000, in particular 2000 to 4000.

The polyaspartic acid can be employed in an amount of 0.1 to 20, preferably 0.5 to 12, in particular 1 to 8% by weight (based on the pelt weight in the case of tanning, on the shaved weight in the case of retanning and on the dyestuff in the case of use as a standardizing agent).

The polyaspartic acid can be used for tanning and retanning in combination with other tanning agents, preferably in a weight ratio of 1:9 to 9:1. Examples of other tanning agents are mineral tanning agents, such as chromium and zirconium compounds, vegetable tanning agents and synthetic organic tanning agents (so-called "syntans"), including resin tanning agents. Examples of such other tanning agents are described in the following literature: F. Schade and H. Träubel, "Neuere Entwicklungen auf dem Gebiet der synthetischen organischen Gerbstoffe" (Recent developments in the field of synthetic organic tanning agents), Das Leder 33 (1982), 142–154; H. Träubel and K.-H. Rogge, "Retannage and Retanning Materials", JALCA 83 (1988), 193–205; K. Faber, "Gerbmittel, Gerbung and Nachgerbung" [Tanning agents, tanning and retanning], Vol. 3 in H. Herfeld, Bibliothek des Leders [Leather library], Frankfurt 1984; EP-A 118 023, 372 746 and DE-A 3 931 039.

The tanning agents and retanning agents can be employed together with fat-liquoring agents and hydrophobizing agents or immediately after one another; cf., for example, M. Hollstein, "Entfetten, Fetten und Hydrophobieren bei der Lederherstellung" [Degreasing, fat-liquoring and hydrophobicizing in leather production], Vol. 4 in H. Herfeld, Bibliothek des Leders, Frankfurt 1984.

The polyaspartic acid is usually used immediately before dyeing.

The use according to the invention of polyaspartic acid is illustrated with the aid of the example of retanning:

Shaved chrome-tanned leather ("wet blue") is neutralized in a drum after brief washing, a pH range of 4.5 to 5 being achieved. This neutralization liquor is then drained off, 100% by weight (based on the shaved weight of the leather) of water of 30° to 50° C. is added, 2 to 5% by weight of polyaspartic acid or its derivative is added, the process is allowed to run for 2 hours and dyeing and fat-liquoring are carried out.

The percentage data in the following examples in each case relate to the weight; parts are parts by weight.

EXAMPLES

A polyaspartic acid (PAA) having a molecular weight of 3000 is employed (as the Na salt) in the following examples.

Example 1

150 g of wet blue (shaved thickness 1.6±0.3 mm) are milled in a small experimental drum with 100% (all % data relate to the shaved weight, i.e. the weight of the wet chrome-tanned leather) of water of 40° C. for 0.2 hour. 1% of sodium formate and 0.2% of sodium bicarbonate are then added and milling is carried out for 0.8 hour; a pH of 4.6 is established. The liquor is discarded and the leather is rinsed for 5 minutes.

Another 100% of water of 40° C. and 2.5% of PAA (as 100% pure solid substance) are now added to the drum and the leather is now milled for 2 hours. Final pH: 4.2.

The liquor is drained off and the leather is rinsed with water for 5 minutes.

For dyeing, 300% of water of 50° C. and 0.5% of BAYGENAL brown CGG are added, the process is allowed to run for 2 hours, the leather is then fat-liquored with 2% of a fat-liquoring agent mixture (of 60 parts of ®CHROMPOL UFB-W, 30 parts of ®CORIPOL DXA and 10 parts of ®CORIPOL ICA; products from Stockhausen GmbH, Krefeld), 1% aqueous formic acid is briefly added, the liquor is drained off and the leather is rinsed, setted out and left to dry in air.

A full, soft leather uniformly dyed brown was formed.

Example 1A

Parallel to Example 1, an experiment was carried out in which everything was the same apart from the fact that instead of PAA the same (with respect to the active ingredient) amount of a commercially available retanning agent based on polyacrylic acid (®BAYTIGAN AR from Bayer AG, Leverkusen) was added.

After the retanning, dyeing and fat-liquoring had been concluded, the two leathers (from Example 1 and 1A) were evaluated by comparison. The leather from Example 1 was significantly darker and more attractively dyed. The plumpness and softness of both leathers were the same.

Examples 2 to 7

150 g of wet blue are treated with 100% of water, 1% of sodium formate and 0.1% of sodium bicarbonate in a shaking bottle at 40° C. for 2 hours. A pH of 5.4 is established. The liquor is drained off and another 100% of water of 30° C. is added.

The following experiments are then carried out:

| Example | 2 | 3 | 4 | 5 | 6 | 7 |
|---|---|---|---|---|---|---|
| % PAA | 6 | — | — | 1.5 | — | — |
| % OS | — | 2 | — | 1.5 | 2 | — |
| % Mim. | — | 2 | — | 1.5 | 2 | — |
| % R7 | — | 2 | — | 1.5 | 2 | — |
| % LevC | — | — | 3 | — | — | — |
| % AR | — | — | 3 | — | — | — |
| pH after 2 hours | 5.8 | 4 | 5.4 | 5.1 | 4.7 | 5 |
| % CGG | 3 | 3 | 3 | 3 | 2.5 | 3 |
| % PAA | — | — | — | — | 1 | — |
| % HCOOH | 1.5 | 1.5 | 1.5 | 1.5 | 1.5 | 1.5 |
| Ref.v. No. 7 | 81 | 64 | 63 | 53 | 49 | 100 |

In this series, the influence of pure PAA retanning (Example No. 2) was compared with standard retanning (Example 3) with 2% of ®TANIGAN OS, 2% of Mimosa and of ®RETINGAN R7 and a polymer retanning (Example No. 4) with 3% of ®LEVOTAN C and 3% of ®BAYTIGAN, a mixed PAA/polymer retanning (Example No. 5), PAA as a dyestuff additive in a standard retanning (Example No. 6) and a blank experiment, i.e. a leather which is not retanned.

The reflectance measurement shows that PAA (No. 2) gives the deepest depth of colour, and that a supply of dyestuff reduced by 25%, with the aid of PAA (No. 6) gives a slightly better colour yield.

The evaluation of the leather showed that No. 5 was fuller and softer compared with No. 3, and No. 2 was comparable in plumpness and softness to No. 3 but was dyed much more deeply.

Examples 8 to 13

Use of PAS in Tanning 200 g of a limed kips pelt are pickled in 40% of water of 20° C. with 6% of sodium chloride as well as 0.4% of formic acid and 0.6% of sulphuric acid. After 90 minutes, a pH of 3.5 is established. The following experiments were then carried out with ®CHROMOSAL B (here called B) in the tanning in 6 bottles.

| Example | 8 | 9 | 10 | 11 | 12 | 13 |
|---|---|---|---|---|---|---|
| % B | 4 | 4 | 4 | 6 | 6 | 4 |
| % PAA | 2 | 2 | 2 | — | 2 | — |
| after 1 h running time | 0.8 | 0.8 | 0.8 | 0.5 | 0.5 | 0.5 |
| % MgO | | | | | | |
| after 1 hr % MgO | — | — | — | 0.3 | 0.1 | 0.3 |
| pH after | | | | | | |
| 3 h | 3.9 | 3.9 | 3.9 | 3.4 | 3.6 | 3.3 |
| 4 h | 4.1 | 4.1 | 4.1 | 3.9 | 3.9 | 4 |
| 16 h | 4.2 | 4.2 | 4.2 | 4.1 | 4.2 | 4.1 |
| Consumption of the chrome tanning agent by measurement of g/l of chromium oxide | | | | | | |
| g/l | 0.14 | 0.11 | 0.12 | 1.84 | 0.63 | 0.66 |
| Neutralization in fresh liquor | | | | | | |
| % NaHCOO | 1 | 1 | 1 | 1 | 1 | 1 |
| pH after 2 h | 4.6 | 4.7 | 4.6 | 4.5 | 4.6 | 4.5 |

Retanning with 3% each of ®TANIGAN OS, Mimosa, ®RETINGAN R7 (resin-based tanning agent of Bayer AG LEV); all the pH values were between 4.2 and 4.3 after 2.5 hours.

Dyeing: dyed with 3% of ®BAYGENAL Black SB (Acid Black 210) and acidified with 1.5% of formic acid. The leathers were finished in the usual way and the depth of colour of the dry leather was evaluated against Experiment No. 11.

| Depth of colour | 104 | 100 | 100 | 100 | 130 | 88 |
|---|---|---|---|---|---|---|

All the leathers were softer than Experiment No. 11 and 13.

It can be seen from this series of experiments (in which in Experiment 9 the PAA was added after 1 hour and in Experiment No. 10 it was added after 2 hours) that—regardless of when the PAA was added—the consumption of the chrome tanning agent was significantly improved in all cases. In the comparison of the experiments with 4% of ®CHROMOSAL B, No. 3 (Experiment without PAA) had an almost 6 times higher amount of chromium in the residual liquor than Experiment 10. In the experiments with 6% of ®CHROMOSAL B (No. 11), the consumption was 3 times better in the presence of PAA (No. 12). Noticeably, the dyeing yield of No. 12 is 30% better than that of No. 11. The colour yield with the tannings with 4% of ®CHROMOSAL B was 12 to 15% lower in Experiment No. 13 (without PAA) than in the experiments in the presence of PAA (No. 8 to 10).

Examples 14 to 15A

To illustrate the positive action as a standardizing agent for leather dyestuffs, the following experiments were carried out:

BAYGENAL brown CGG (Colour Index Acid Brown 83), which normally comprises 49.4% of sodium sulphate, was treated with the same amount of PAS.

If a leather retanned in accordance with the Eitel standard (3% of TANIGAN OS, 3% of Mimosa, 3% of RETINGAN R7) is dyed with 1% of dyestuff, the dyeing with the dyestuff standardized with PAA (Experiment 14A) is significantly deeper in colour at 120 (against 100 with the dyestuff standardized with sulphate; Experiment 14).

BAYGENAL grey L-NG (Acid Black 173) comprises 24.1% of sodium chloride as the standardizing agent. Replacement of the sodium chloride by PAA gave the following results:

| Experiment No. | % of dyestuff | Depth of colour of the dyeing |
|---|---|---|
| 15 | 1 | 100 |
| 15A | 1 | 114 |

Good results were likewise achieved with buffed suede leathers—depending on the retanning.

We claim:

1. In the tanning or re-tanning of leather wherein the leather is contacted with a liquor containing a tanning agent, the improvement wherein said agent comprises polyaspartic acid or a salt or anhydride thereof.

* * * * *